US006827586B2

(12) United States Patent
Noda et al.

(10) Patent No.: US 6,827,586 B2
(45) Date of Patent: Dec. 7, 2004

(54) LOW-PROFILE CONNECTOR FOR CIRCUIT BOARDS

(75) Inventors: Atsuhito Noda, Hachioji (JP); Yoshihiro Tetsuka, Yamato (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/372,865

(22) Filed: Feb. 24, 2003

(65) Prior Publication Data

US 2003/0166347 A1 Sep. 4, 2003

Related U.S. Application Data

(63) Continuation-in-part of application No. 10/060,736, filed on Jan. 30, 2002.

(30) Foreign Application Priority Data

Feb. 22, 2002 (JP) ..... 2002-46542

(51) Int. Cl.[7] ..... H01R 12/00
(52) U.S. Cl. ..... 439/71; 439/591; 439/862
(58) Field of Search ..... 439/71, 66, 91, 439/67, 72, 591, 862

(56) References Cited

U.S. PATENT DOCUMENTS

| | | | | |
|---|---|---|---|---|
| 4,161,346 A | * | 7/1979 | Cherian et al. | 439/66 |
| 4,199,209 A | * | 4/1980 | Cherian et al. | 439/591 |
| 4,341,433 A | | 7/1982 | Cherian et al. | 339/176 |
| 5,427,535 A | * | 6/1995 | Sinclair | 439/66 |
| 5,938,451 A | | 8/1999 | Rathburn | 439/66 |
| 6,042,389 A | | 3/2000 | Lemke et al. | 439/74 |
| 6,045,416 A | | 4/2000 | Sinclair | 438/857 |
| 6,106,305 A | | 8/2000 | Kozel et al. | 439/66 |
| 6,178,629 B1 | | 1/2001 | Rathburn | 29/843 |
| 6,193,537 B1 | | 2/2001 | Harper, Jr. et al. | 439/291 |
| 6,231,353 B1 | * | 5/2001 | Rathburn | 439/66 |
| 6,409,521 B1 | * | 6/2002 | Rathburn | 439/66 |

OTHER PUBLICATIONS

U.S. Appl. No. 10/060,736, filed May 30, 2002.
EPO Search Report in prior PCT Application No. PCT/US30/04961 counterpart.

* cited by examiner

*Primary Examiner*—Gary Paumen
*Assistant Examiner*—Edwin A. Leon
(74) *Attorney, Agent, or Firm*—Thomas D. Paulius

(57) ABSTRACT

A connector for mounting to a circuit board, includes a housing and a plurality of terminals arranged side by side at the predetermined pitch. Each terminal includes a flat base portion, a pair of contact members formed from a continuous folded-back portion that is folded back to one side of the flat base portion, and a carrier coupling section that is bent at substantially right angle to the opposite side of the flat base portion. The housing holds the terminals by an over-molding of the housing around the flat base portions of the terminals to form a generally flat plate-like housing. The pair of contact members of the terminal extends toward one surface of the dielectric housing and the carrier coupling section extends toward the other surface of the housing.

17 Claims, 10 Drawing Sheets

PRIOR ART

LOW-PROFILE CONNECTOR FOR CIRCUIT BOARDS

REFERENCE TO RELATED APPLICATIONS

This application is a continuation-in-part application of prior application Ser. No. 10/060,736, filed Jan. 30, 2002 for "Low Profile Receptacle Connector".

BACKGROUND OF THE INVENTION

The present invention relates generally to receptacle connectors, and more particularly, to receptacle connectors that are used to make connections between an integrated circuit ("IC") package having numerous contacts, such as a BGA or LGA contacts, and a printed circuit board having numerous contacts pads formed thereon.

FIG. 7 illustrates a known connector having numerous terminals 300 embedded in an insulative housing 301. In use, the housing 301 is sandwiched between an IC package (not shown) and a printed circuit board 302. Each terminal 300 of the connector typically includes a contact arm 304 that is applied against a selected contact pad 303 of the circuit board 302, and a contact 305 integrally formed to the contact arm 304 for touching a selected counter contact, typically a spherical or land-shaped contact of the IC package. The connector housing 301 has retainers 306 formed therein which hold terminals 300 in the housing 301 in such a way that each contact 305 is resilient enough to yieldingly move, or sink, when applied to the counter contact.

The presence of these retainers 306 formed in or as part of the terminal housing 301 prevents reduction of the thickness of the connector housing. The known receptacle connector of FIG. 7 is too thick for use in notebook computers, which have been getting smaller and thinner. Also disadvantageously, this known connector allows its contact arm ends to be stained with flux in soldering to conductor pads 303. Also, soldering material is allowed to attach to its contact arm ends in the form of whiskers.

In the past, similar style connectors have been used to connect circuit boards together and they are also too thick for today's thin and sleek computers. FIGS. 13 and 14 show an example of such a prior art connector, and in particular, FIG. 13 shows one terminal 1000 of the connector. A plurality of such terminals 1000 are mounted or press-fitted to a housing 2000 (FIG. 14) in order to complete an electrical connector 3000. Although only one terminal 1000 is shown in the figure, a plurality of such terminals 1000 are actually arranged side by side at the predetermined pitch. Referring to FIG. 6, the terminal 1000 includes a pair of contact members, or arms 1010, a press-fit portion 1020 formed at the base of the contact members, and a fixing portion 1030 formed adjacent the press-fit portion for connection to a solder ball 1040. The terminal 1000 is produced from a thin metal sheet by a stamping and forming process.

The terminal 1000 is received in a terminal receiving cavity (not shown) formed in the housing 2000 so that the press-fit portion 1020 may be press-fit against the inner wall of the terminal receiving cavity to hold the terminal 1000 in place. The solder ball 1040 is soldered to the fixing portion 1030 of the terminal 1000 and a portion of the solder ball 1040 opposite to the fixing portion 1030 externally projects from the housing 2000.

In FIG. 14, the mating connector 4000 is shown to include a dielectric housing 6000 having a plurality of contact pins 5000 mounted therein, which pins 5000 correspond to pairs of contact members of the terminals 1000 in the connector 3000 with one-to-one relation. The connector 3000 and the mating connector 4000 form a connector assembly. In general, each of the connectors 3000 and 4000 is mounted to their respective printed circuit boards so that they may be connected to each other via the connectors 3000 and 4000.

In addition to the terminal receiving cavity, as described above, another means for holding the terminal in the dielectric housing has been known in the art in which a terminal mounting channel is formed through the housing and a side edge of the terminal is latched to an opposite inner wall of the terminal mounting channel (see Japanese Patent Laid-Open No. 11-144821, for example).

These prior art connectors have a problem in that mounting of their terminals requires a number of assembly steps and thus adds cost to manufacturing because each terminals has to be press-fit to the terminal-receiving cavity or channel. In view of the recent tendency in electronics toward multi-pole configuration and higher terminal densities and with the advent of such design that not less than 100 terminals are arranged side by side at higher density, there is a strong need to solve the problem as above.

Furthermore, the prior art such terminal-receiving cavities or mounting channels formed in the housing create other problems such as when soldering the connector to the circuit board, wicking of either solder or solder flux may be produced via a clearance between the terminal and its cavity or channel, which may cause contamination to the contact members mated with the terminals of the mating connector.

In view of the above an object of the present invention is to provide an electrical connector having an improved configuration that reduces the manufacturing cost of the connector and eliminates the problem of solder or solder flux wicking.

SUMMARY OF THE INVENTION

Accordingly, it is a general object of the present invention to provide a circuit board connector of reduced thickness which utilizes solder balls on each side of its connector housing as electrical contacts.

Another object of the present invention is to provide a low-profile receptacle connector for BGA or LGA applications, the connector including a thin housing in the form of a socket, the socket having a plurality of cavities formed therein, a plurality of terminals disposed in the cavities, each of the terminals having a flat terminal body portion with at least two opposing edges, the terminal including a terminal retention arm extending in one direction from one of the two terminal body portion edges and a terminal retention stub extending in a second direction from the other of the two terminal body portion edges, the terminal flat body portion having shape that permits it to be held in place within a molding cavity such that molding material from which the connector housing is formed may flow around the terminal retention arm and stub to retain the terminal in place within the connector housing, thereby eliminating the need for forming terminal retainers in the connector housing associated with each connector housing cavity.

To attain such object an electrical connector for mounting to a printed circuit board, comprising a dielectric housing and a plurality of terminals arranged side by side at the predetermined pitch, is improved according to the present invention in that: each of the terminals includes a flat base portion, a pair of contact members formed from a first continuous folded-back portion that is folded back onto one side of the flat base portion, and a second folded back section bent transverse to the base portion, but extending on the opposite side of the base portion; the housing holds the terminals by performing an over-molding of the housing around the flat base portions of the terminals to form a generally flat plate-like housing; and the pair of contact members of the terminal extends toward one surface of the housing and the carrier coupling section extends toward the other surface of the housing.

According to one embodiment of the present invention, the pair of contact members of each terminal is disposed in a recess formed in said one surface of the housing.

According to another embodiment of the present invention, the other surface of the housing is provided with an opening leading to the terminal flat base portion, and the connector further includes solder balls soldered to the flat base portion via the openings and that externally project beyond the other surface of the housing.

According to further embodiment of the present invention, the terminal further includes a bent portion connecting between the flat base portion and the carrier coupling section, and a cut-out portion formed in the bent portion into which resin material that forms the housing, is permitted to flow, thereby anchoring the terminal base portion in place within the housing According to another aspect of the present invention there is provided an electrical connector assembly, comprising: an electrical connector constructed in the manner as described above; and a mating connector comprising a plurality of contact pins each corresponding to each pair of contact members of the terminals with one-to-one relation, and a housing holding the contact pins by an over-molding of the housing around the contact pins to form a substantially flat plate-like housing.

According to one embodiment of the present invention one surface of the housing of the mating connector is provided with an opening leading to a base portion of the contact pin, and the mating connector further includes a solder ball soldered to the base portion via the opening and that is externally projected beyond said one surface of the housing.

An electrical connector according to the present invention is advantageous in the following points of view: Firstly, because of the configuration in which the housing is over-molded to the terminal consisting of the base portion, the pair of contact members and the carrier coupling section so that the terminal is held in the housing, there is no terminal press-fitting step required, and therefore, an efficient manufacturing process can be realized even for the electrical connector having an increased number of terminals. Furthermore, because of no clearance that extends through the housing between the housing and terminal, there is no possibility of any rising action of solder or solder flux occurred during the soldering operation on the printed circuit board.

Secondly, because the pair of contact members of the terminal are confined in a recess of the housing, the pair of contact members are protected by the housing against any deformation or contamination thereto.

Thirdly, because of the solder ball soldered to the base portion of the terminal and externally projected from the housing, a connector of ball grid array (BGA) type is provided. Alternatively, a connector of pin grid array (PGA) type in which a pin-like solder tail for DIP soldering or a solder tail for surface soldering (SMT) may be provided on the carrier coupling section of the terminal may be provided within the scope of the present invention.

Fourthly, because of the presence of a bent portion between the base portion and the carrier coupling section, a cut-out portion is formed in the bent portion, which assists in reducing the distance (or pitch) between adjacent terminals of the connector as much as possible. This is very suitable for smaller pitch arrangement of the terminals.

Fifthly, because the mating connector also has the same configuration in which its own dielectric housing is over-molded to a number of contact pins, there is provided the electrical connector assembly having a capability of easily and efficiently mating the electrical connector with the mating connector. Such connector assembly eliminates any possibility of rising action of solder or solder flux during the process of mounting the connector to the circuit board.

Sixthly, the mating electrical connector may be an electrical connector of BGA type.

These and other objects, features and advantages of the present invention will be clearly understood through a consideration of the following detailed description.

BRIEF DESCRIPTION OF THE DRAWINGS

In the course of this detailed description, the reference will be frequently made to the attached drawings in which.

DESCRIPTION OF THE PREFERRED EMBODIMENTS

Figure 1:
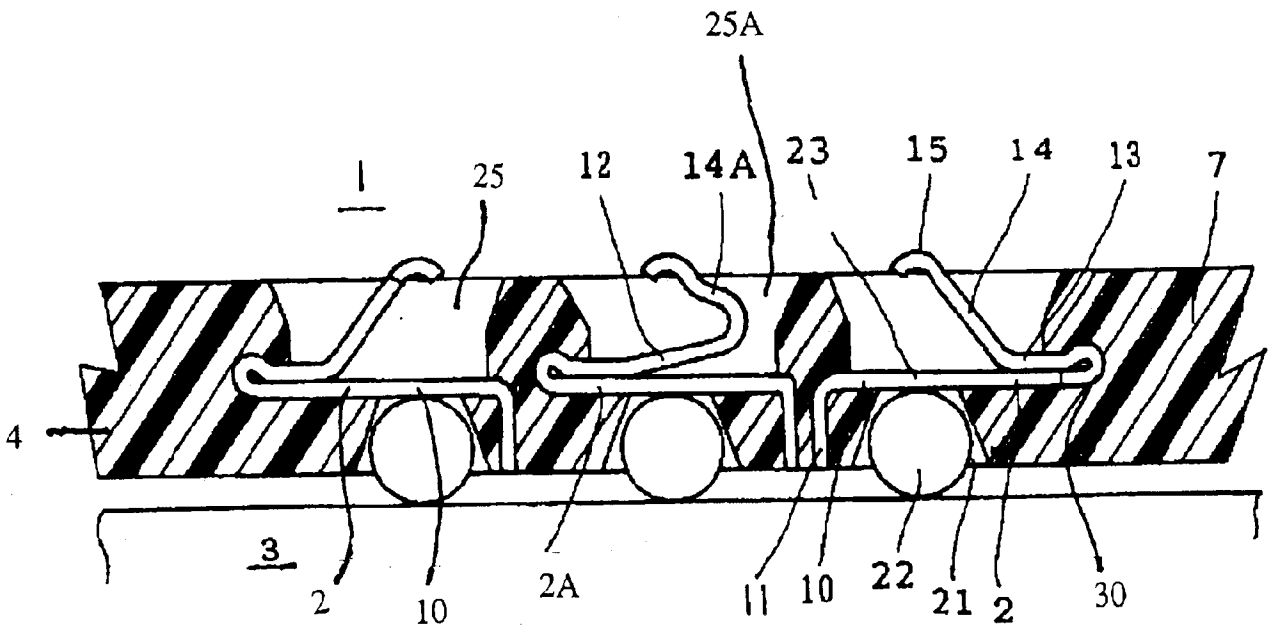
FIG. 1 is an enlarged sectional view of a first embodiment of a receptacle connector constructed in accordance with the principles of the present invention.
Figure 2:
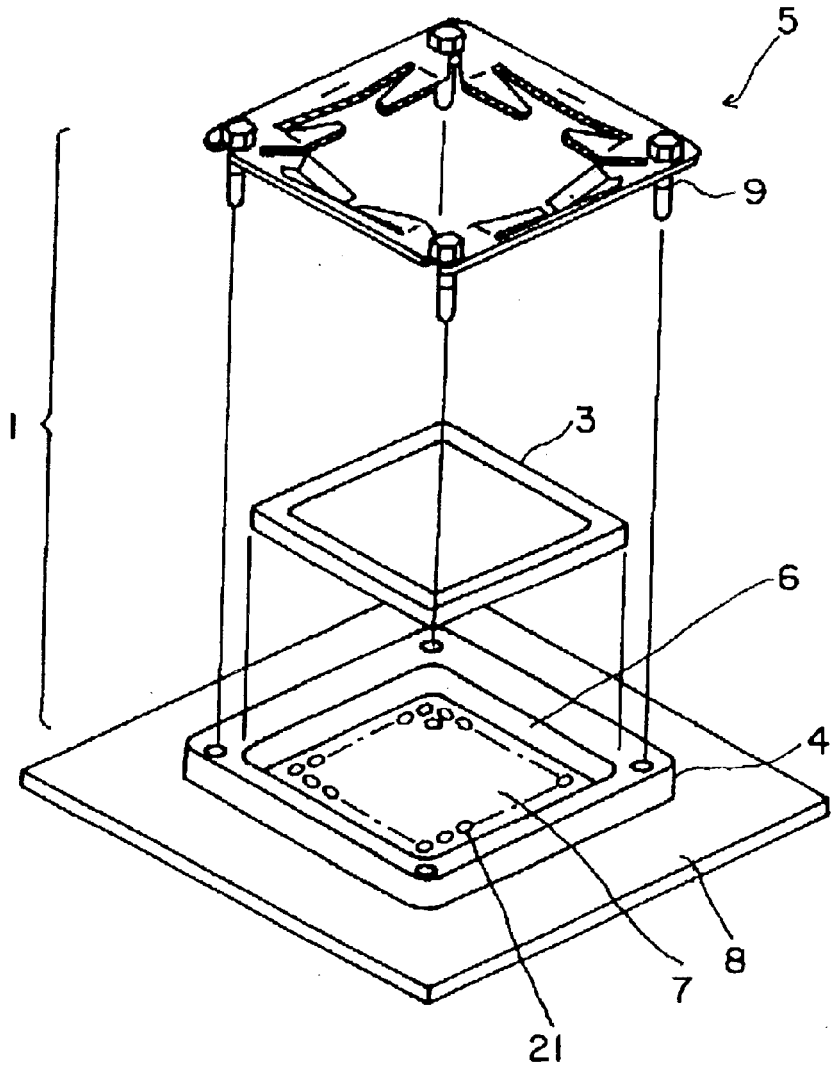
FIG. 2 is an exploded view of the receptacle connector of FIG. 1.

FIGS. 1 and 2 illustrate a receptacle connector assembly 1 constructed in accordance with the principles of the present invention, and which is used in making electrical connections between an IC package such as a BGA or LGA type of IC package and a circuit board 8. The connector includes an insulative, molded housing 4, formed as a receptacle for receiving an IC package 3 and a resilient cover 5. A series of conductive terminals 2 are arranged in the form of lattice, and are embedded in the bottom 7 of the package-containing space of the housing 4. The receptacle housing 4 is laid on the circuit board 8, and the IC package 3 is put in the square space 6 of the receptacle housing 4. Finally, a resilient cover 5 may be laid on the integrated circuit package 3 to be fixed with screws 9. The receptacle housing 4 is preferably molded from an insulating material, such as a plastic or a dielectric material, while the resilient cover 5 is preferably formed, such as by stamping it, from a thin sheet of metal.

Figure 3:
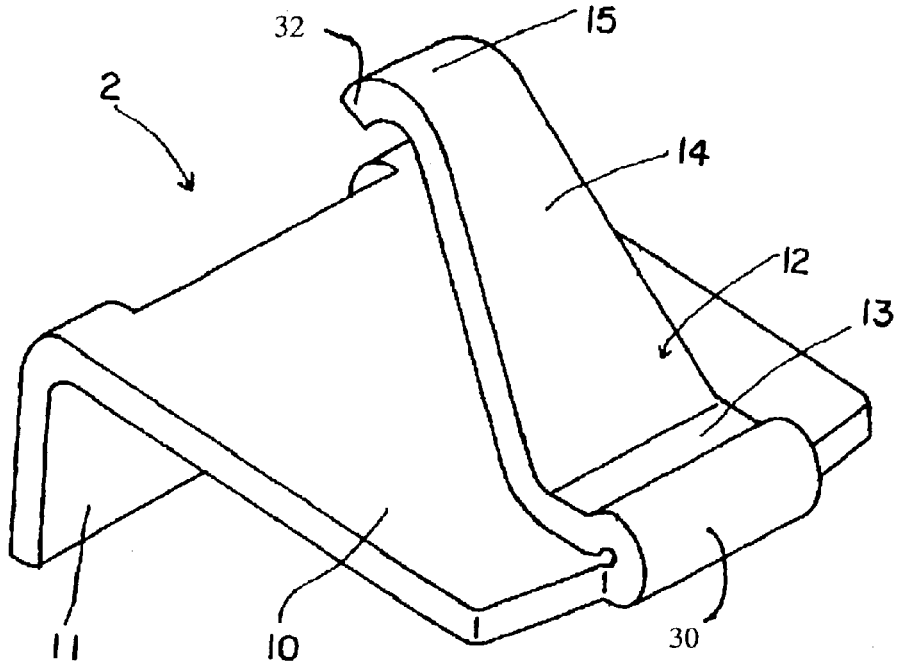
FIG. 3 is a perspective view of a terminal used in the connector of FIG. 1 and of the present invention.

The conductive terminals 2 of the connector assembly 1 are also preferably stamped out of a sheet of metal. As shown in FIG. 3, the terminal 2 preferably includes a flat trunk, or body portion 10, having an extension portion that takes the form of an arm 11, that is formed on one lateral edge of the body portion 10, with the extension arm extending away from the body portion in one direction, either "upwardly" or "downwardly" from the flat body portion 10, depending on the orientation of the connector. Each such terminal 2 further includes a cantilever-like contact arm 14 that extends away from, and preferably obliquely from the other, or opposite, lateral edge of the body portion 10 and a retention stub 13 of the terminal, and preferably from a U-shaped bend or joint 13. This retention stub 13 preferably extends generally parallel to the flat surface of the body portion 10 and generally along the same plane as the flat body portion 10, although this coplanarity is not required. The retention stub 13 extends in a horizontal plane, while the retention arm 11 extends in a vertical plane. The cantilever-like contact arm 14 preferably terminates in a free end 32 that includes an inwardly curved contact end 15.

Such terminals 2 are housed in recesses, or cavities 6, that are formed on the bottom of the receptacle housing 4 in the form of lattice, or other suitable arrangement. Each terminal 2 is housed in a selected recess 6 with its flat body portion 10 laid on the bottom of the receptacle housing recess, and the longitudinal and lateral opposite edges of the flat body portion 10, namely retention arm 11 and the U-shaped retention stub 13 to be embedded in a mold for the receptacle connector. Thus, with elements 11 and 13 extending into the area that is covered with the housing molding material, the terminals 2 are firmly held in the housing mold, while still retaining a good resilience in its protruding cantilevered contact arm 14.

Figure 4:
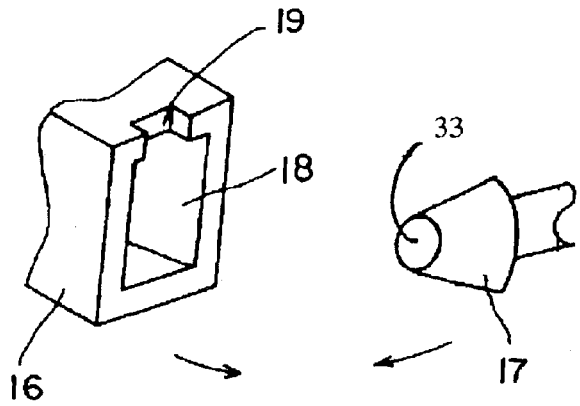
FIG. 4 is a perspective view of paired molds that are used in molding the housing of the receptacle connector of FIG. 1.

More specifically, each terminal 2 of the type illustrated in FIG. 1 is preferably sandwiched between the first and second mold sections 16 and 17 illustrated in FIG. 4 during molding of the receptacle connector housing 4. As seen from FIG. 4, in the first mold section 16, a plurality of cavities 18 may be formed for accommodating the upper side of the terminal shown in FIG. 3, namely the side of the terminal from which the cantilevered contact arm 14 extends. A rectangular notch 19 is formed adjacent the cavity 18 for receiving the retention stub 13 of the terminal 2, and particularly the U-shaped joint 30 thereof. The cavity 18 receives the cantilevered contact arm 14. The second mold section 17 takes the shape of frustum of a cone, thereby permitting its top, and preferably its flat head 33 to be applied closely to the center of the mold cavity, and within part of the first mold section 16 so that the head 33 will lie adjacent to the flat body portion 10 in the area in the housing that accommodates the terminal flat body portion 10.

Figure 5:
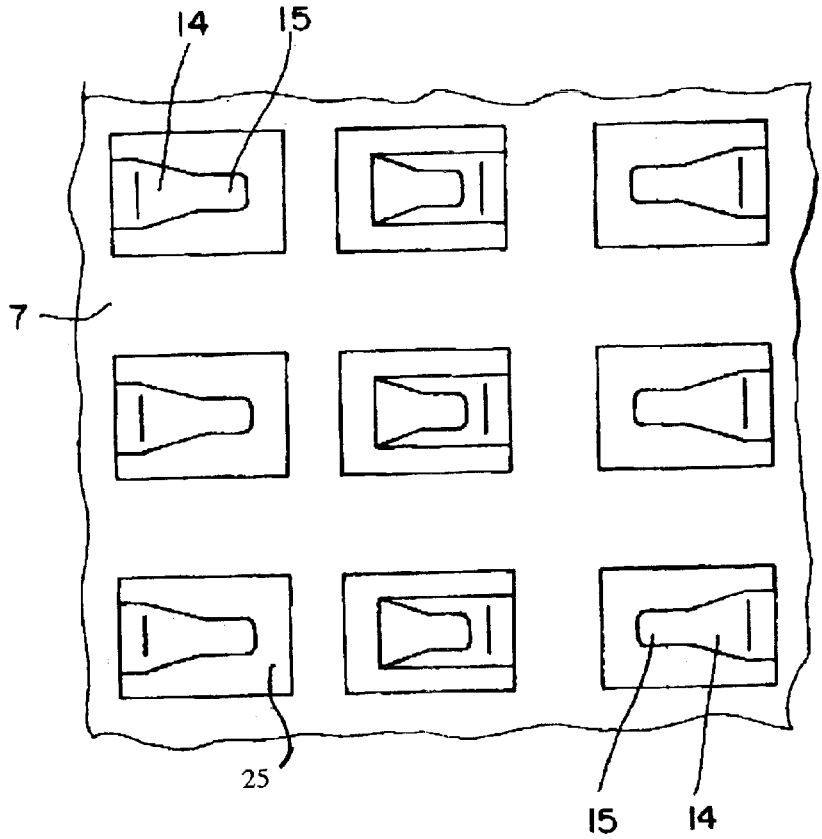
FIG. 5 is an enlarged bottom plan view of a section of the receptacle connector of FIG. 1.

Referring now to FIGS. 1 and 5, and particularly FIG. 5, it can be seen that the contact ends 15 of the cantilevered contact arms 14 appear on the bottom of the receptacle housing 4 in a pattern taking the form of a lattice, thus permitting the contact ends 15 to contact opposing contact pads of the circuit board 8 in a one-to-one confronting relation. Each one of the terminals is disposed within a single cavity 25 of the receptacle connector housing.

Referring to FIG. 1 again, the receptacle housing 4 has numerous holes, or cavities 21, that are formed on and communicate with the IC package accommodating space 6. These cavities 21 are made by inserting the second mold sections 17 (the frustum of a cone) as a first step of molding. Then, the terminals 2 are laid in place within the mold cavity and in contact with the first mold sections so that their flat body portions 10 contact the heads 33 of the second mold sections. In this manner, the contact between the two will ensure that the terminal flat body portions 10 are partially exposed in the receptacle connector housing 4. The first mold sections 16 are then put into place in the mold cavity and over the terminals 2, thereby securing them in place within the mold. Housing material is then injected into the mold cavity and around the first and second mold sections and the retention members are thus firmly embedded in the connector housing. The receptacle connector assembly 1 thus provided permits its exposed flat body portions 10, 23 to be placed into contact with the spherical contacts, shown as solder balls 22, of the printed circuit board 8. The solder balls 23 and the contact arms 14 extend out of and past the exterior surfaces on the connector housing in opposite directions.

As may be understood from the above, all the terminals 2 are arranged with their flat body portions 10, 23 parallel to the opposing major surfaces of the receptacle housing 4, and their retention arms and stubs at the lateral edges 11, 13 are embedded in the mold. Thus, the distance between the IC package 3 and the circuit board 8, and hence the profile of the receptacle connector assembly 1 can be reduced to possible minimum. Moreover, each terminal is free of being stained with soldering flux or free of solder being attached in the form of whiskers or strands, thanks to the "U"-shaped joint being embedded in the mold.

In FIG. 1, the cantilevered contact arm 14A of the center terminal 2A is different in shape from those of the other terminals 2. This terminal 2A is yieldingly bent to be flat when being pushed by the mold sections 16, 17 and removal of the two mold sections will allow the terminal 2 to return to its stress-free initial shape.

Figure 6:
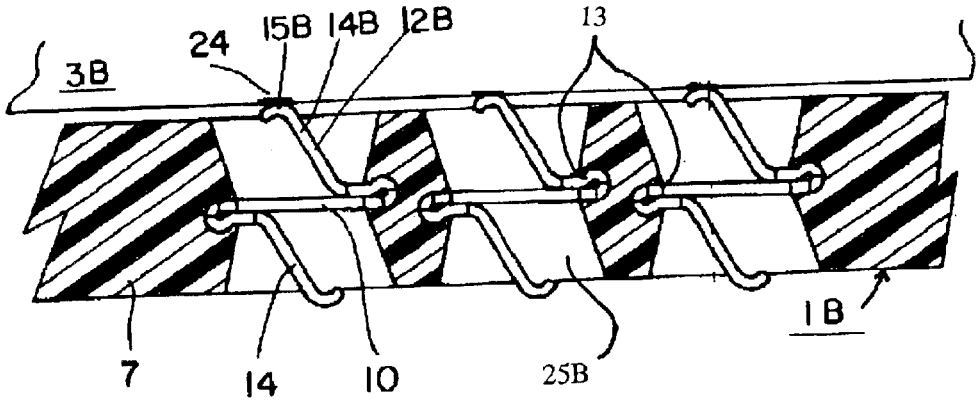
FIG. 6 is an enlarged longitudinal section of a second embodiment of a receptacle connector constructed in accordance with the principles of the present invention.
Figure 7:
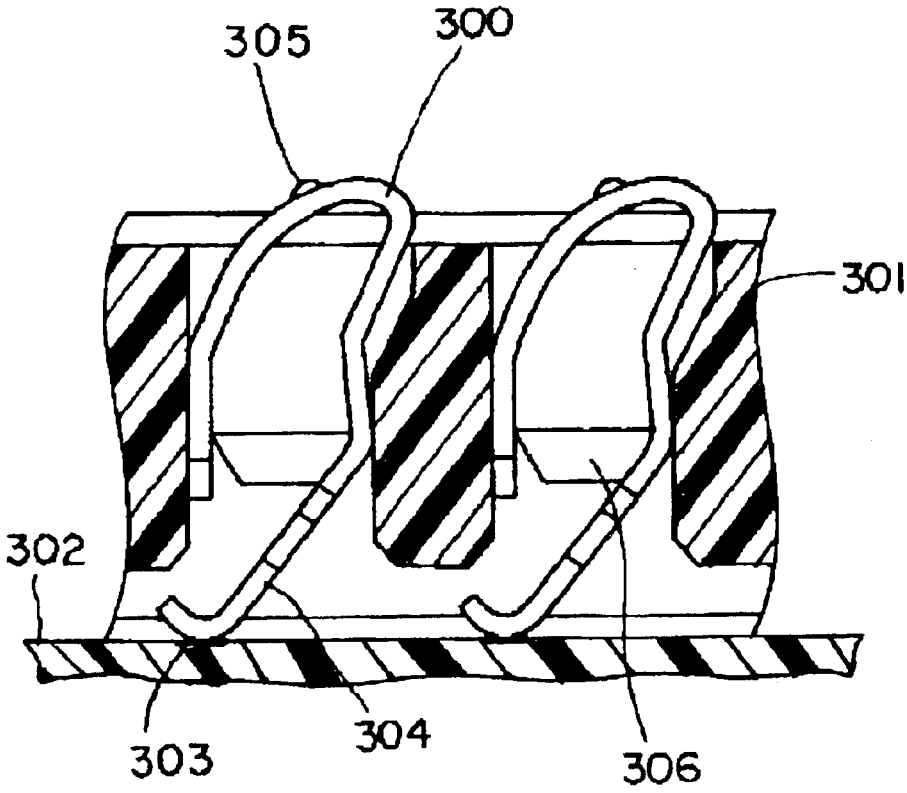
FIG. 7 is an enlarged sectional view of a portion of a conventional receptacle connector.

Referring now to FIG. 6, a second embodiment of a receptacle connector 1B constructed in accordance with the principles of the present invention is illustrated and utilizes terminals, each terminal has two cantilever-like contact arms 14 and 14B that are connected to, and preferably integrally formed with the opposite lateral edges of the flat body portion 10, meaning that they project from the flat body portions 10 and define thereat, two opposing retention stubs 13. The retention stubs 13 extend in horizontal planes, but in different directions. the free ends of the contact arms 14, 14B extend out of the connector housing and past the exterior surfaces thereof. In this particular embodiment, the receptacle connector 1B has an additional lattice-like arrangement of contacts 15B that extend on both sides of the connector so that they may confront an overlying IC package 3B and make contact with contact pads 24 thereof such as a land-grid type of IC package when fitted in the space 6 of the receptacle connector housing 4.

Figure 8:
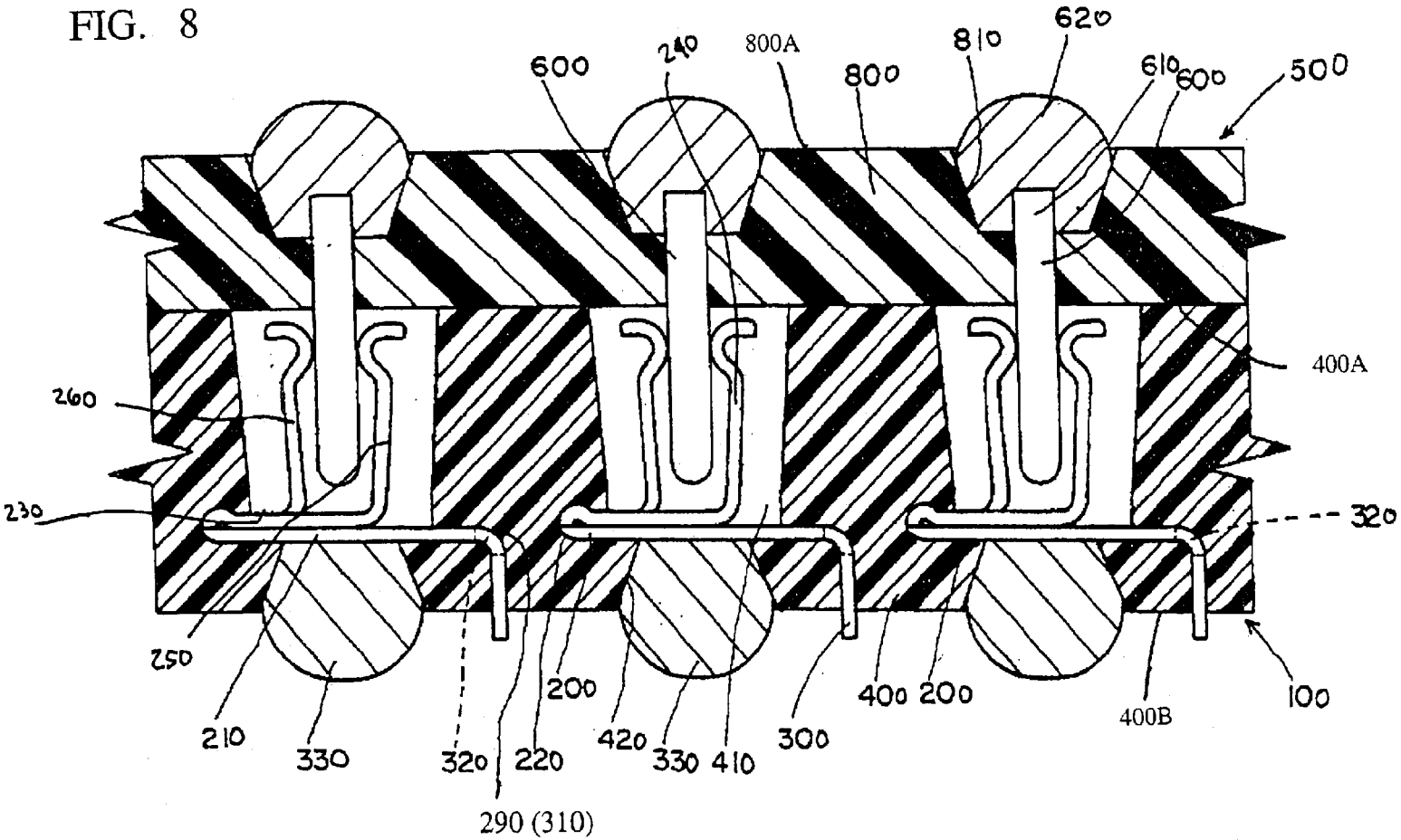
FIG. 8 is a cross-sectional view partially illustrating another embodiment of the invention in the form of a board-to-board solder ball grid array connector assembly and illustrated connected together.

Referring now to FIGS. 8–12, an alternate embodiment of the invention is illustrated. FIG. 8 illustrates, in cross-section, a connector assembly consisting of a connector 100 and a mating electrical connector 500, both of which can be mated together. The connector 1000 includes a plurality of terminals 200 arranged in side-by-side order at a predetermined pitch and a dielectric housing 400 is molded onto the terminals 200, preferably by over-molding. The mating connector 500 includes a plurality of contact pins 600 arranged in a side-by-side to correspond to the terminals 200 on the connector of the invention, also in a one-to-one relation, and a dielectric housing 800 is over-molded onto the contact pins 600. The terminals 200 and the contact pins 600 are arranged at the predetermined pitch in the right-to-left direction, as is shown in FIG. 8, and in addition, they are arranged in the direction perpendicular to the plane of the paper of FIG. 8.

Figure 9:
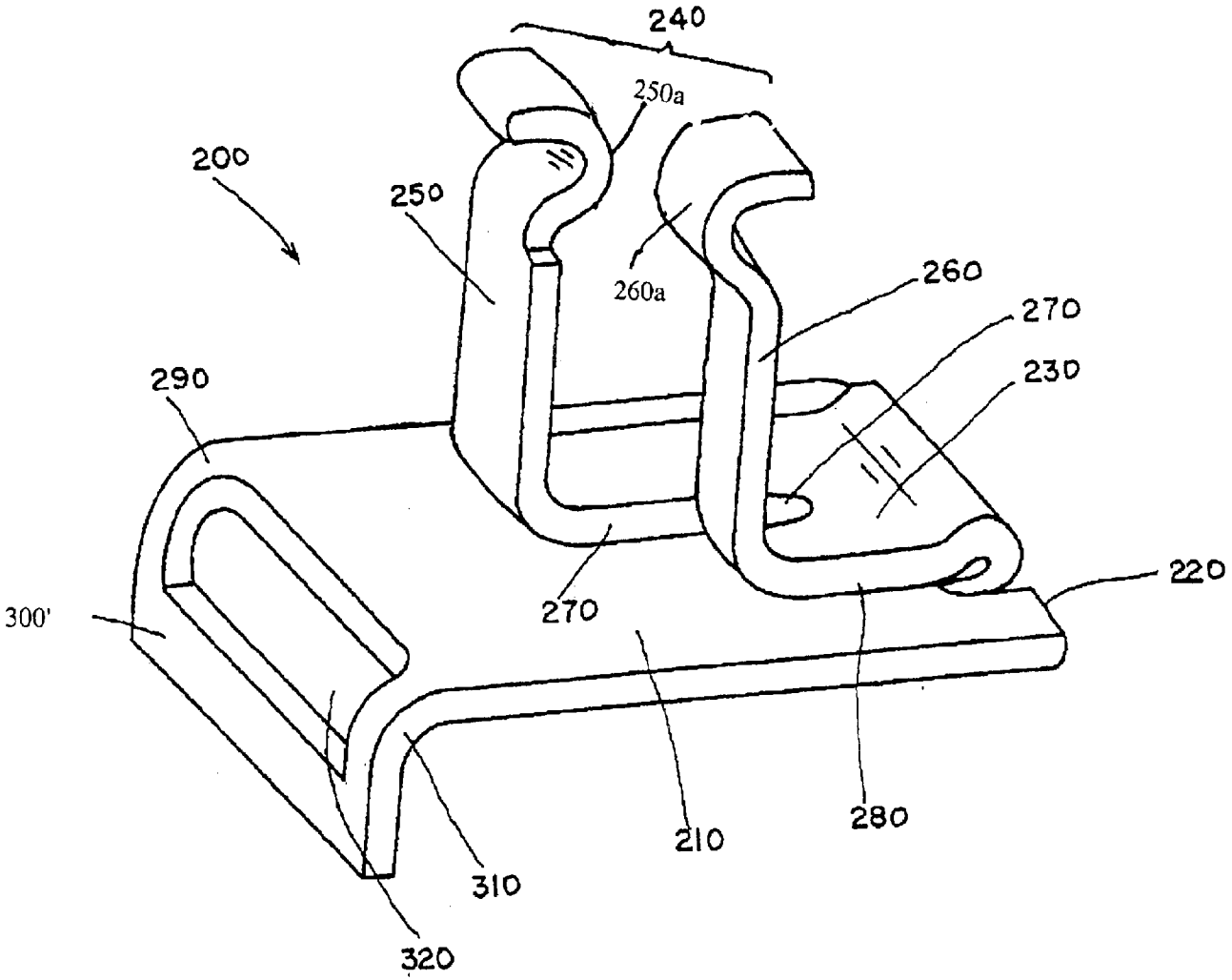
FIG. 9 is a perspective view of one of terminals of the connector assembly of FIG. 8.

Each of the terminals 200 of the connector 100 is produced by preferably stamping and forming it from thin sheet metal in the shape as shown in FIG. 9. In particular, the terminal 200 is produced to include a base portion 210 in the form of a flat rectangular plate, a continuous folded-back portion 230 that is folded back along one edge 220 of the base portion 210 on one side (upper side) thereof to have the width smaller than that of the base portion 210, and a pair 240 of contact members, or arms, that are partially formed as part of the folded-back portion 230. The pair 240 of contact members includes a first and second contact members, that take the form of upwardly projecting arms 250, 260.

The one contact arm 250 may have a width that is slightly greater than the width of the other contact arm 260. The contact arms 250 and 260 are formed in such manner that a separation channel 270 is defined longitudinally in the continuous folded-back portion 230 to form a bifurcated contact portion, which is then bent at substantially a right angle to the plane of the base portion 210. The contact arms 250 and 260 include respective base pieces 270, 280 which extend in parallel with and above the base portion 210, (FIG. 9) and which have different lengths from each other so that the contact pin 600 can be received between the contact arms 250 and 260. Curved contact portions 250*a* and 260*a* are formed at the free ends of the contact arms 250 and 26. The contact portions 25*a*, 26*a* are resiliently deformed to separate slightly from each other when the contact pin 600 is received therebetween but do not completely separate so as to lose engagement with the contact pin 600.

The terminal base portions 210 are aligned with terminal-receiving cavities 400, 410 and preferably seal them off so as to define two separate, aligned sub-cavities, shown in FIG. 1 as being above and below the flat base portions 210 of the terminals 200. As shown in the drawings, the contact arms 250, 260 extend upwardly from the base portion 210 into the first sub-cavity, while the second sub-cavity receives a solder ball 330 therein.

The terminal 200 further can be seen to include a carrier strip coupling section 300 (FIG. 9) that also may be considered as a folded-back piece in that it is bent at substantially a right angle along an other edge 290 of the base 210 and extends toward the opposite (lower) side of the base portion 21. The carrier coupling section 300 has the same width as the base 210. A bent portion 310 is provided for connecting between the base 210 and the carrier strip coupling section 300, and an opening 320 is preferably formed in the bent portion 310.

The housing 400 is preferably over-molded over the terminals 200 and serves to embed four sides, or edges of the terminal base portion 210 to form a generally flat plate-like housing. In this regard, the pair 240 of contact arms extend toward one housing surface 400A (the upper surface of FIG. 8), while the carrier strip coupling section 300' extends toward the opposite housing surface 400B. A recess is defined by the first sub-cavity 410 of the housing and opens to the housing upper surface 400A and it has a size and the depth suitable for receiving the pair of contact arms 240 so that they do not externally project from the housing 400. A similar, second sub-cavity 420 lead communicates with both the terminal base 210 and the second, or lower surface 400B of the housing 400. The carrier strip coupling section 300' may slightly project from the housing opposite surface 400B, as shown. A resin material for the housing 400 is injected into the cut-out portion 320 in the bent portion 310 connecting between the carrier coupling section 300' and the terminal base 210.

Each conductive terminal 200 is held at the predetermined positions due to the molding of the housing 400 over them, and a solder ball 330 is provided in the opening, or second sub-cavity 420, formed in the lower part of the housing 400. The solder ball 330 is soldered to the center area of the terminal base 210 that is exposed in the opening 420 and a portion of the solder ball 33 projects outwardly beyond the housing opposite surface 400B.

Figure 10:
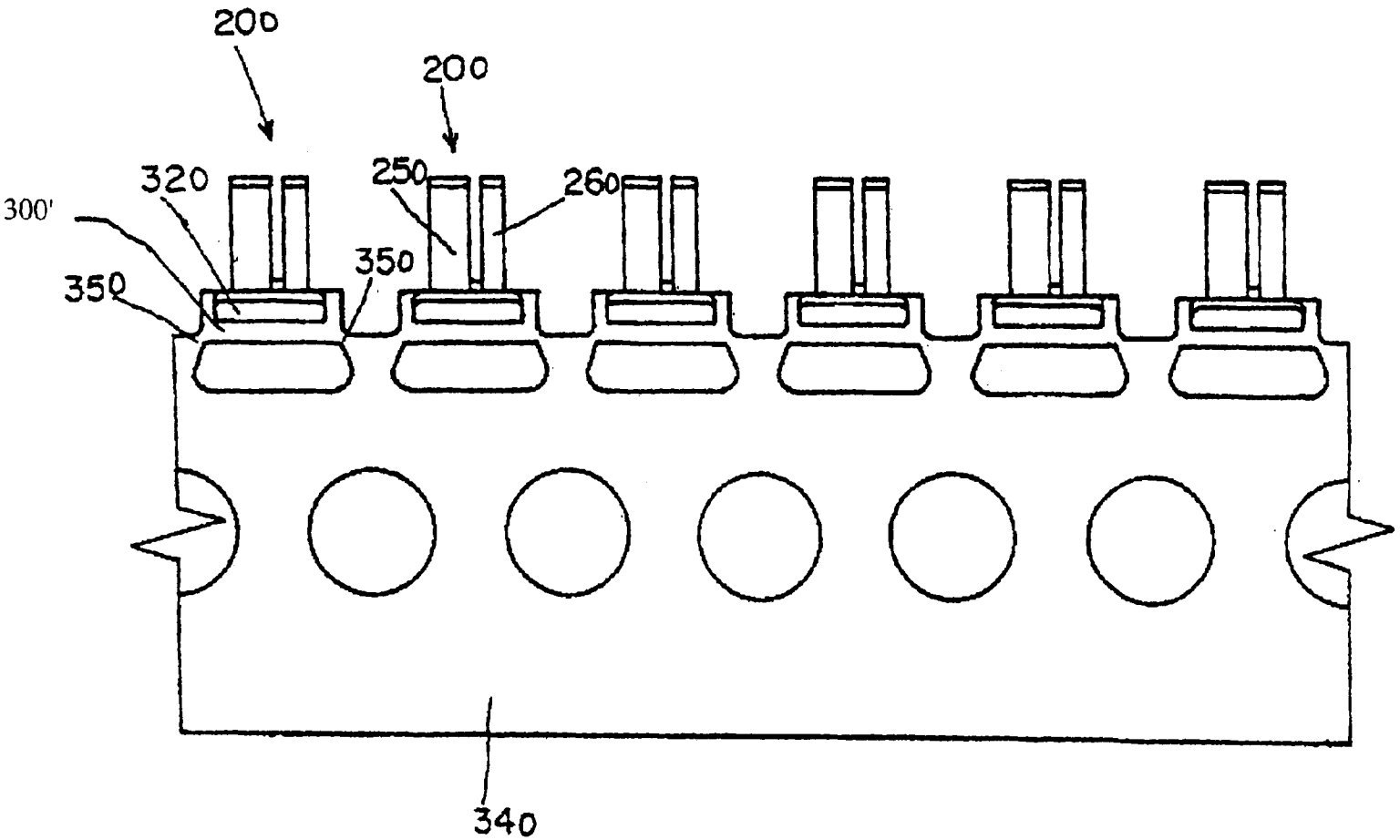
FIG. 10 is an elevational view of the terminals of FIG. 9 illustrated as coupled to a carrier strip.
Figure 11:
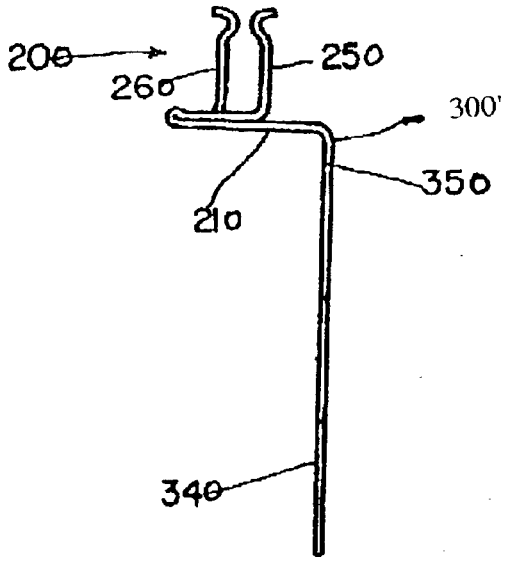
FIG. 11 is a side view of the carrier strip of FIG. 10.

FIGS. 10 and 11 show a series of terminals 200 coupled to a carrier strip 340 at the time before the over-molding of the housing 400 onto the terminals. The carrier coupling sections 300' of the terminals 200 are coupled to the carrier strip 340 via frangible breaking portions 350. The over-molding of the housing 400 is preferably performed while the terminals 200 are still coupled to the carrier strip 340, and thereafter the carrier strip 340 is separated at the position of the breaking portions 350. Alternatively, the terminals 200 may be separated from the carrier 340 and set in their predetermined positions in the mold (not shown), and thereafter, the over-molding of the housing 400 may be performed.

In the mating connector 500, an over-molding of the housing 800 is performed on the contact pins 600 so as to embed the middle portions thereof and to form a generally flat plate-like housing of the connector 100. The base 610 of the contact pin 600 faces an opening 810 formed in one surface 800A of the housing 800. A solder ball 620 is positioned in the opening 810. The solder ball 620 is soldered to the contact pin base 610 and a portion of the solder ball 620 is projects beyond the outer surface of the housing 800.

Figure 12:
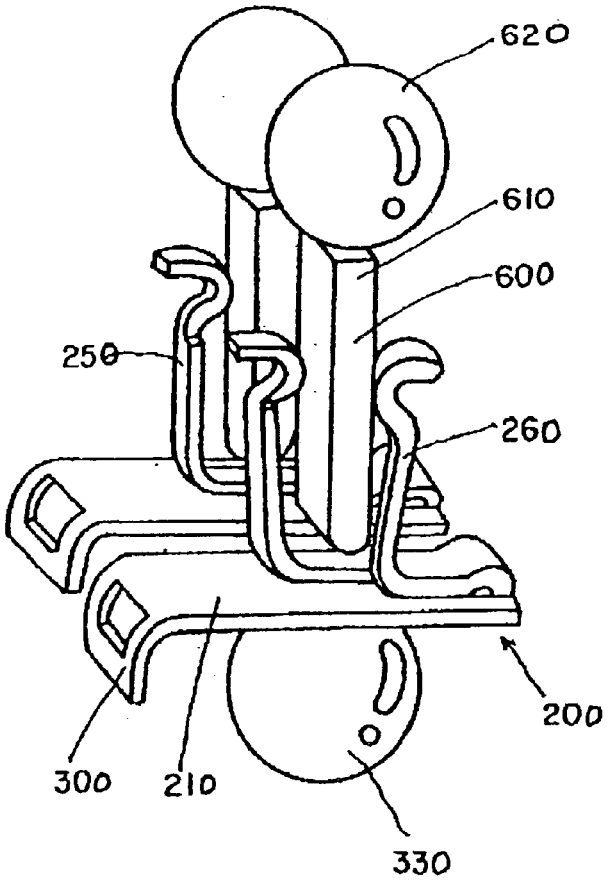
FIG. 12 is a perspective view of two terminals of FIG. 8, shown interconnected but with the supporting housing removed for clarity.
Figure 13:
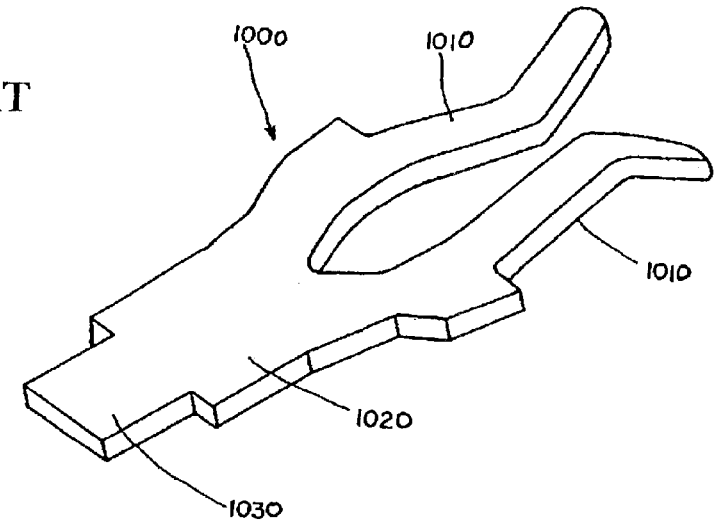
FIG. 13 PRIOR ART
FIG. 13 is a perspective view of a prior art terminal.
Figure 14:
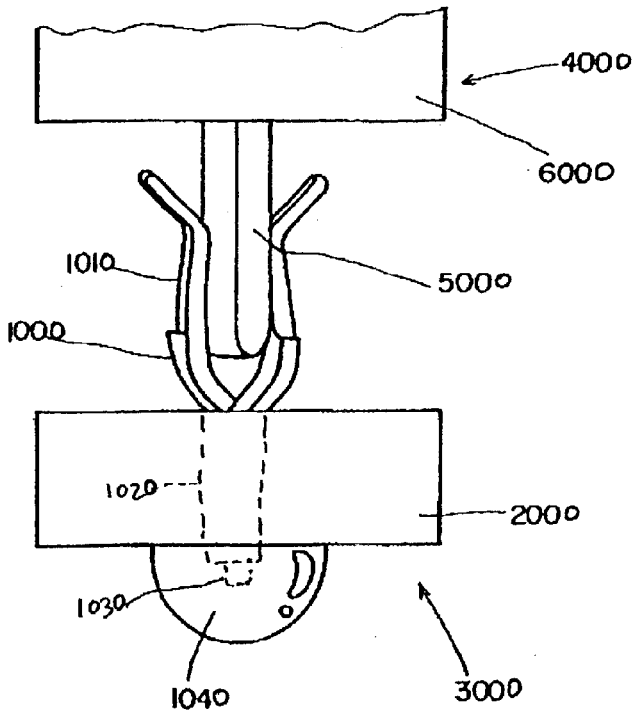
FIG. 14 PRIOR ART
FIG. 14 is an elevational view illustrating the prior art terminal of FIG. 13 in place within a connector and mated to a mating connector.

FIG. 12 is a view illustrating only the terminals 200, the contact pins 600 and the solder balls 330, 620 in such condition that the connectors 100, 500 are mated together.

As described above, because of the configuration of the connector 100 in which the housing 400 is over-molded to the terminals 200, there is no press-fitting step for the terminals 200 required, and therefore, an efficient manufacturing process can be realized even for the connector 100 with an increased number of terminals 200. Furthermore, because of the configuration in which the housing 400 is over-molded to the terminals 200, there is no clearance produced at the boundary between the terminals 200 and the housing 400. Therefore, there is no possibility of any rising action of solder or solder flux along the contact members occurred during the soldering operation in which the solder ball 330 is soldered to the base portion 210 of the terminal 200 and to the contact pad on the printed circuit board. This allows to keep the pair of the contact members clean and to avoid any loss in electrical connection.

The same is true for the mating connector 500. In particular, because of the configuration in which the housing 800 is over-molded to the contact pins 600, there is no press-fitting step for the contact pins 600 required and there is no possibility of any rising action of solder or solder flux occurred during the soldering operation of the solder ball 620.

Because of the configuration in which the pair 240 of terminal contact arms are confined in the recess 410 formed in the housing 400 without any portions thereof projecting externally, the pair 240 of the contact arms can be protected against any unintended contact by a hand or any foreign matter before mating with the mating connector 500. In other words, they can be protected against any deformation or contamination. Moreover, it is possible to avoid such condition that any electrostatic charge is discharged via the pair 240 of the contact members to the circuit on the board to damage some components in the circuit.

The opening portion 320 formed in the bent portion 310 between the base 210 and the carrier coupling section 300' of the terminal 200 provides an advantageous effect in that any possibility of short circuiting between one edge 220 of one terminal 200 and the other edge 290 of the adjacent terminal 200 can be eliminated, and therefore, the distance (or the pitch) between the adjacent terminals 200 can be reduced to as small as possible. This is very effective for a small sized connector 100, and more particularly, for such connector that has an increased number of terminals 200. Because of a resin material flowed into the cut-out portion 320 for producing the housing 400, the higher integrity between the terminals 200 and the housing 400 is assured, which prevents any movement of the terminals 200.

Because of the solder ball 330 soldered to the terminal 200 and partially projected from the housing 400, the connector 100 of BGA type where a multiplicity of terminals are arranged at higher density can be provided. The same is true for the mating connector 500. Alternatively, a connector having no such solder ball 330 may be provided. In such case, the carrier coupling section 300' of the terminal 200 may be connected to a pin-like DIP solder tail externally projected from the housing 400 or to an SMT solder tail. Then the solder tail may be coupled to the carrier 340 via a breaking portion.

It is apparent from the foregoing that, because of the configuration of a connector in which a dielectric housing is over-molded to terminals arranged side by side at the predetermined pitch, there is no press-fitting step for the terminals required, and therefore, an efficient manufacturing process can be realized even for the connector having an increased number of terminals. Furthermore, because of no clearance produced at the boundary between the terminals and the housing, there is no possibility of any rising action of solder or solder flux occurred during the soldering operation, which allows to keep the pair of the contact arms clean and to avoid any loss in electrical connection.

What is claimed is:

1. A connector comprising:

an insulative housing including a body portion with opposing first and second exterior surfaces, a plurality of terminal-receiving cavities formed in the housing body portion, each of the terminal-receiving cavities extending through said housing body portion to the housing opposing first and second surfaces; and, a plurality of conductive terminals disposed in said terminal-receiving cavities, a single one of the terminals being disposed in a single cavity, each of the terminals including:

a terminal body portion extending horizontally within its associated terminal-receiving cavity, the terminal body portion having a plurality of distinct edges, first and second terminal retention members being disposed along first and second opposing edges of said body portion, and a contact portion that extends away from said terminal body portion, within the associated terminal-receiving cavity, the two terminal retention members being embedded in said housing to thereby hold said terminal body portion in place within said housing, said terminal first retention member including an extent folded back upon said terminal body portion along said terminal body portion first edge and said terminal second retention member including a retention stub disposed along said terminal body portion second opposing edge, the retention stub being formed by bending another extent of said terminal body portion at an angle to said terminal body portion, said retention stub further including an opening formed therein along said terminal body portion second edge, the opening being filled with material from which said housing is made and thereby providing a means for anchoring said terminal within said housing.

2. The connector of claim 1, wherein said contact portion includes a pair of contact arms disposed on one side of said terminal body portion, the contact arms being spaced apart from each other, each of the contact arms including a curved contact head, the contact heads of said contact arms engaging an opposing connector terminal on opposite sides thereof.

3. The connector of claim 1, wherein said terminal contact portion includes a slot disposed therein which defines a pair of contact arms, each of the contact arms having a free end spaced from said terminal base portion.

4. The connector of claim 2, wherein said contact arms do not project past a surface of said housing.

5. The connector of claim 3, wherein said contact arm free ends include curved contact faces.

6. The connector of claim 1, wherein said terminal-receiving cavities are closed off intermediate said housing opposing first and second surfaces by said terminal body portions.

7. The connector of claim 6, wherein said terminal body portions divide each terminal- receiving cavity into first and second sub-cavities, the first sub-cavity opening to said housing first surface and said second sub-cavity opening to said housing second surface.

8. The connector of claim 7, wherein said second sub-cavity includes a solder ball disposed therein and in contact with said terminal body portion, the solder ball projecting out of said second sub-cavity past said housing second surface.

9. The connector of claim 1, wherein said second terminal retention member extends toward said housing second surface.

10. The connector of claim 9, where said second terminal retention member terminates in a stub end and said stub end protrudes past said housing second surface.

11. An electrical connector assembly for interconnecting together two circuit boards, the connector assembly comprising:

first and second interengaged connector components;

the first connector component including a first insulative connector housing having opposing first and second surfaces, a plurality of conductive contact pins disposed in the first connector housing and extending past the first connector second surface, said first connector housing further including a plurality of recesses disposed in said first connector housing second surface, the contact pins extending into the recesses, and solder balls disposed in said first connector housing second surface in contact with said contact pins and extending past said first connector housing second surface; and, the second connector component including a second insulative connector housing having opposing first and second exterior surfaces, a plurality of terminal-receiving cavities formed in the second connector housing, each of the terminal-receiving cavities extending completely through said second connector housing and communicating with said second connector housing first and second surfaces, a plurality of conductive terminals disposed in said terminal-receiving cavities, a single one of the terminals being disposed in a single cavity, each terminal including a body portion extending horizontally within its associated terminal-receiving cavity, the terminal body portion including first and second terminal retention members being disposed along first and second opposing edges of said terminal body portion, and a contact portion extending away from said terminal body portion within a portion of its associated terminal-receiving cavity, the two terminal retention members being embedded in said housing to thereby hold said terminal body portion in place within said second connector housing, said terminal first retention member including an extent folded back upon said terminal body portion along said terminal body portion first edge and said terminal second retention member including a retention stub disposed along said terminal body portion second opposing edge, the retention stub being formed by bending another extent of said terminal body portion at an angle to said terminal body portion, said second connector further including a plurality of solder balls disposed in said terminal-receiving cavities and extending past said second connector housing second surface.; and, said first connector contact pins extending into said second connector housing terminal-receiving cavities and being engaged with said second connector terminal contact portions when said first and second connector housings are mated together such that said solderballs are arranged on opposite sides thereof.

12. The connector assembly of claim 11, wherein a free end of said second retention member projects past said second connector housing second surface.

13. The connector assembly of claim 11, wherein each of said second connector terminal retention stubs include an opening formed therein along said terminal body portion second edge, the opening being filled with material from which said second connector housing is made and thereby providing a means for anchoring said terminal within said second connector housing.

14. The connector assembly of claim 11, wherein said second connector component terminal contact portions each include a pair of spaced-apart contact arms, each of the contact arms having an engagement surface disposed thereon for engaging opposing surfaces of said first connector component contact pins.

15. The connector assembly of claim 14, wherein said terminal base portions seal off said terminal-receiving cavities and further divide each of said cavities into first and second sub-cavities, said terminal contact portions extending into said first sub-cavities and having a length less than a depth of said first sub-cavities whereby, said contact arms do not extend past said second connector housing first surface.

16. A connector comprising:

an insulative housing including a body portion with opposing first and second exterior surfaces, a plurality of terminal-receiving cavities formed in the housing body portion, each of the terminal-receiving cavities extending through said housing body portion to the housing opposing first and second surfaces; and, a plurality of conductive terminals disposed in said terminal-receiving cavities, a single one of the terminals being disposed in a single cavity, each of the terminals including:

a terminal body portion extending horizontally within its associated terminal-receiving cavity, the terminal body portion having a plurality of distinct edges, first and second terminal retention members being disposed along first and second opposing edges of said body portion, said terminal body portions dividing each terminal-receiving cavity into first and second sub-cavities, the first sub-cavity opening to said housing first surface and said second sub-cavity opening to said housing second surface, and a contact portion that extends away from said terminal body portion, within the associated terminal-receiving cavity, the two terminal retention members being embedded in said housing to thereby hold said terminal body portion in place within said housing, said terminal first retention member including an extent folded back upon said terminal body portion along said terminal body portion first edge and said terminal second retention member including a retention stub disposed along said terminal body portion second opposing edge, the retention stub being formed by bending another extent of said terminal body portion at an angle to said terminal body portion, said retention stub further including an opening formed therein along said terminal body portion second edge, the opening being filled with material from which said housing is made and thereby providing a means for anchoring said terminal within said housing.

17. The connector of claim 16, wherein said second sub-cavity includes a solder ball disposed therein and in contact with said terminal body portion, the solder ball projecting out of said second sub-cavity past said housing second surface.

* * * * *